US006554047B1

(12) United States Patent
Mondragon et al.

(10) Patent No.: US 6,554,047 B1
(45) Date of Patent: Apr. 29, 2003

(54) GUIDE TRACK ASSEMBLIES AND MOUNTING BRACKETS FOR UPWARD ACTING DOORS

(75) Inventors: Joseph J. Mondragon, Dallas, TX (US); Richard K. Hoofard, Dallas, TX (US); Robert K. Wright, Rowlett, TX (US); James W. Compton, Roanoke, TX (US); LeRoy G. Krupke, Carrollton, TX (US); Robert S. Cogger, Athens, GA (US)

(73) Assignee: Overhead Door Corporation, Dallas, TX (US)

( * ) Notice: Subject to any disclaimer, the term of this patent is extended or adjusted under 35 U.S.C. 154(b) by 0 days.

(21) Appl. No.: 09/610,806

(22) Filed: Jul. 6, 2000

(51) Int. Cl.[7] ..... E05D 15/06

(52) U.S. Cl. ..... 160/201; 160/188; 160/189; 49/200

(58) Field of Search ..... 160/188, 189, 160/200, 201, 209, 133; 49/199, 200; 248/224.8, 225.11, 225.21

(56) References Cited

U.S. PATENT DOCUMENTS

| | | | | | |
|---|---|---|---|---|---|
| 2,271,309 | A | | 1/1942 | Rowe | |
| 2,327,778 | A | | 8/1943 | Ferris et al. | |
| 2,630,597 | A | | 3/1953 | Robinson | |
| 2,827,114 | A | | 3/1958 | Stroup | |
| 3,662,874 | A | * | 5/1972 | Muller | 198/155 |
| 3,693,693 | A | | 9/1972 | Court | |
| 3,848,920 | A | | 11/1974 | Linhart et al. | |
| 4,483,045 | A | * | 11/1984 | Shelton et al. | 16/95 R |
| 4,930,563 | A | | 6/1990 | Finch et al. | |
| 5,036,899 | A | | 8/1991 | Mullet | |
| D337,042 | S | | 7/1993 | Lin et al. | |
| 5,240,216 | A | | 8/1993 | Lin et al. | |
| 5,409,051 | A | | 4/1995 | Mullet et al. | |
| 5,429,170 | A | | 7/1995 | Nogaki | |
| 5,568,672 | A | | 10/1996 | Mullet et al. | |
| 5,636,678 | A | * | 6/1997 | Carper et al. | 160/201 X |
| 5,718,533 | A | | 2/1998 | Mullet et al. | |
| 5,772,471 | A | * | 6/1998 | Buck | 439/607 |
| 5,797,694 | A | * | 8/1998 | Breivik | 403/231 |
| 5,865,235 | A | * | 2/1999 | Krupke et al. | 160/201 X |
| 5,954,111 | A | * | 9/1999 | Ochoa | 160/201 |
| 5,964,268 | A | * | 10/1999 | Carper et al. | 160/201 X |
| 6,047,761 | A | * | 4/2000 | Jaehnen et al. | 160/201 |
| 6,094,779 | A | * | 8/2000 | Young | 160/201 X |
| 6,125,582 | A | * | 10/2000 | Mondragon et al. | 49/200 |
| 6,134,835 | A | * | 10/2000 | Krupke et al. | 49/200 |
| 6,227,281 | B1 | * | 5/2001 | Martin | 160/201 |
| 6,250,360 | B1 | * | 6/2001 | Ochoa | 160/201 |
| 6,325,134 | B1 | * | 12/2001 | Mullet | 160/189 |
| 6,328,091 | B1 | * | 12/2001 | Whitley | 160/201 |

* cited by examiner

*Primary Examiner*—Bruce A. Lev
(74) *Attorney, Agent, or Firm*—Gardere Wynne Sewell LLP

(57) ABSTRACT

Guide track assemblies for upward acting doors include substantially linear vertical and horizontal track sections and curvilinear transition sections formed as portions of each of the vertical and horizontal linear sections. The track assemblies are supported, respectively, by mounting brackets which also support a counterbalance mechanism for the door. The curvilinear transition track sections are formed integral with the vertical and horizontal track sections and may have a constant or elliptical radius of curvature, the latter to provide clearance for the guide track assemblies in low headroom installations. The mounting brackets are formed of stamped metal plates which are folded to provide a first flange for attaching the mounting bracket to a structural wall, a support part including a flag portion for connection to the guide track sections and a second flange for connection to a door counterbalance mechanism.

21 Claims, 7 Drawing Sheets

GUIDE TRACK ASSEMBLIES AND MOUNTING BRACKETS FOR UPWARD ACTING DOORS

FIELD OF THE INVENTION

The present invention pertains to circular radius and elliptical radius configurations of guide track assemblies for upward acting doors and including combined mounting brackets for the guide track assemblies and door counterbalance mechanisms.

BACKGROUND

In the art of upward acting single and multi panel garage doors, and the like, there has been a continuing need to develop door guide track assemblies which are easy to install and which can accommodate door installations where low headroom or low ceiling height conditions are encountered. In particular, there has also been a continuing need to develop simplified guide track mounting brackets which reduce the manufacturing cost and installation time associated with the production and installation of upward acting doors. The present invention meets the above mentioned needs and desiderata and overcomes the disadvantages of prior art guide track assemblies and support structure therefor.

SUMMARY OF THE INVENTION

The present invention provides improved guide track assemblies and mounting brackets therefor for use with upward acting garage doors and the like.

In accordance with one aspect of the present invention, improved guide track assemblies are provided which include two piece track assemblies which make up the entire lengths of the track assemblies including the vertical track section, a transition section and a substantially horizontal track section. In one embodiment of the improved track assemblies, the transition section is substantially of circular radius of curvature and each track section includes a curved section of approximately equal circumferential extent.

In another embodiment in accordance with the invention, a two piece track assembly is provided which includes a substantially vertical section, a variable radius of curvature transition section and a substantially horizontal section. The track assembly is adapted for low headroom or low ceiling height installations. In a preferred embodiment of the low headroom track assembly, the radius of curvature is elliptical and the two piece track assembly includes a first vertically extending track section having a minor portion of a curved transition section and the second track section comprises the horizontal section and a major portion of the curved transition section. The elliptical track section is preferably provided with major and minor axes having a length ratio of about 2:1.

In accordance with a further aspect of the present invention, the track assemblies include improved mounting brackets which are also adapted to support counterbalance mechanisms for associated upward acting doors. The mounting brackets preferably comprise formed metal or plastic integral brackets which include elongated slots formed therein to provide for adjusting the positions of the track assemblies with respect to associated support structure including the wall surrounding the door opening. The one piece integral mounting brackets each accommodate selective positioning of the track assemblies with respect to the wall to which the mounting bracket is attached and also eliminate the requirement for a separate, generally horizontally extending bracket part for supporting a track assembly. Moreover, the mounting brackets are advantageously configured to be fabricated of stamped and folded metal plate, for example. Still further, integral mounting tabs or flanges are formed on the mounting brackets to facilitate attachment of the brackets to support structure including the wall surrounding the door opening.

Those skilled in the art will further appreciate the above mentioned advantages and superior features of the invention together with other important aspects thereof upon reading the detail description which follows in conjunction with the drawings.

DETAILED DESCRIPTION OF PREFERRED EMBODIMENTS

Figure 1:
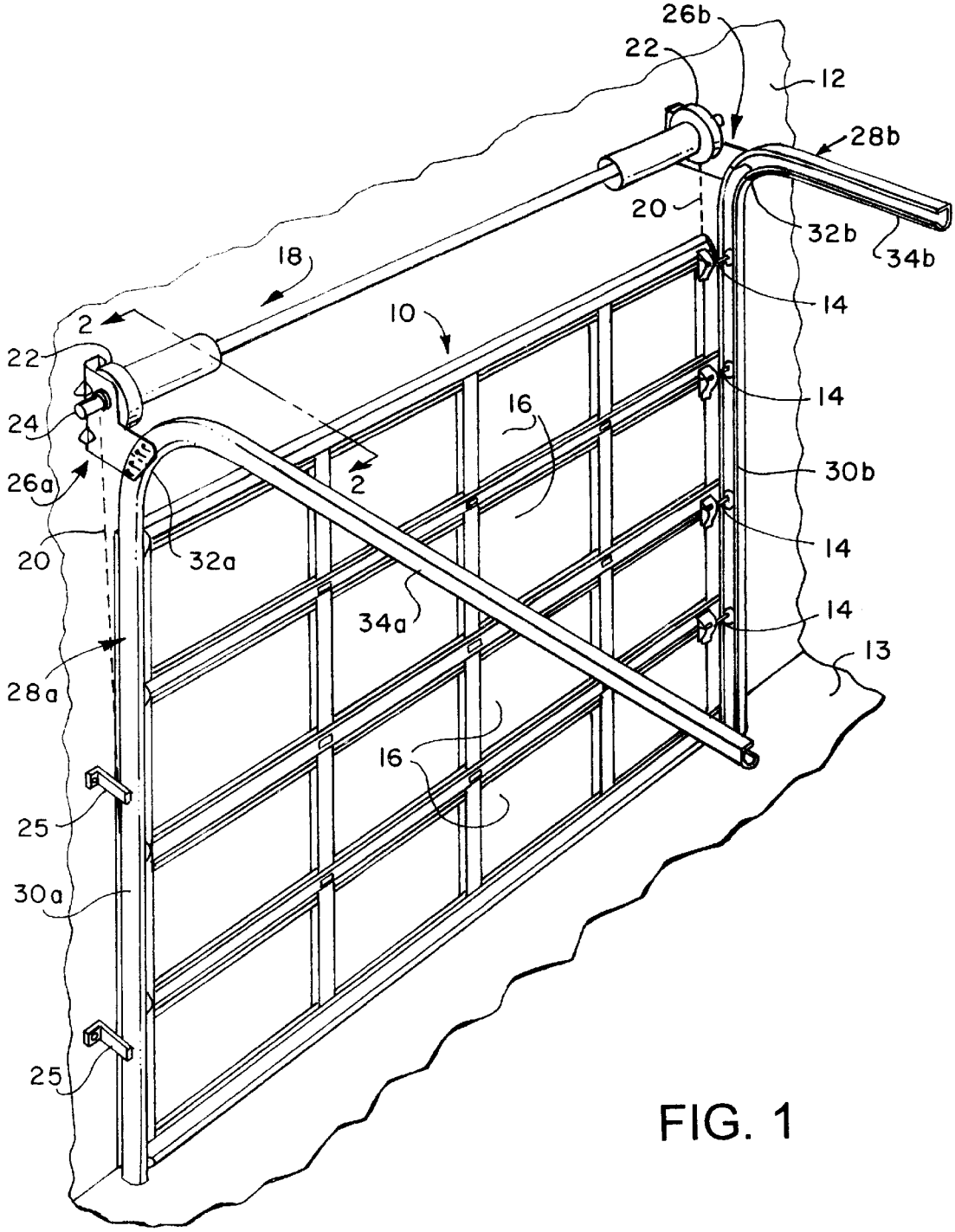
FIG. 1 is a perspective view of one preferred embodiment of an improved guide track assembly and mounting brackets therefor in accordance with the present invention.

In the description which follows, like parts are marked throughout the specification and drawing with the same reference numerals, respectively. The drawing figures may not be to scale and certain features may be shown in general or somewhat schematic form in the interest of clarity and conciseness.

Referring to FIG. 1, there is illustrated a sectional upward acting door, generally designated by the numeral 10, which is mounted adjacent a wall 12 for closing a conventional rectangular opening, not shown, in said wall. The door 10 is provided with spaced apart sets of roller type guide members 14, which may be of conventional construction, and are shown mounted on one side edge of sectional door panels 16, respectively. Corresponding guide members 14 are mounted on the opposite side edge of each of the panels 16 in a conventional manner.

Referring further to FIG. 1, the door 10 is also provided with a counterbalance mechanism, generally designated by the numeral 18. The counterbalance mechanism 18 is adapted to suspend spaced apart cables or similar flexible members 20 which depend along opposite sides of the door 10 and are connected to the lowermost panel 16 in a conventional manner for counterbalancing at least part of the weight of the door. One counterbalance mechanism which may be used with the invention is preferably of a type disclosed in co-pending U.S. patent application Ser. No. 09/096,663 filed Jun. 12, 1998 by LeRoy G. Krupke, et al. and assigned to the assignee of the present invention. Improvements in mounting structure for the aforementioned counterbalance mechanism are disclosed and claimed in co-pending patent application Ser. No. 09/313,460 filed May 17, 1999 by Joseph J. Mondragon, et al. and also assigned to the assignee of the present invention. The entire subject matter of the two aforementioned patent applications is incorporated herein by reference.

The counterbalance mechanism 18 is provided with spaced apart cable drums 22 supported by a shaft 24 which is adapted to be mounted in spaced apart support brackets 26*a* and 26*b,* which support brackets also are adapted to support opposed guide member track assemblies 28*a* and 28*b* in a unique manner. The support brackets 26*a* and 26*b* are substantially identical and are configured as mirror images of each other thereby comprising so called left hand and right hand brackets. In like manner, the track assemblies 28*a* and 28*b* are also substantially identical and comprise mirror images of each other. Track assembly 28*a* includes a substantially vertically extending section 30*a* and supported relative to wall 12 by mounting brackets 25, FIG. 1. Track section 30*a* is also adapted to include a portion of a curved transition section 32*a*. Track assembly 28*a* also includes a substantially horizontal extending track section 34*a* which further includes a portion of the transition section 32*a*. Transition section 32*a* has a substantially circular or constant radius of curvature. Track section 34*a* is preferably supported at a distal end by a conventional support bracket, not shown. In like manner, track assembly 28*b* includes a vertically extending track section 30*b,* a transition section 32*b* having a substantially circular radius of curvature and a generally horizontal track section 34*b*. The transition sections 32*a* and 32*b* are formed as integral parts of the track sections 30*a* and 34*a* and 30*b* and 34*b,* respectively. Track sections 30*a* and 34*a* are joined to each other at support bracket 26*a*. In like manner, track sections 30*b* and 34*b* are joined to each other at the cooperating support bracket 26*b* and are otherwise supported in a manner similar to track assembly 28*a*.

Figure 2:
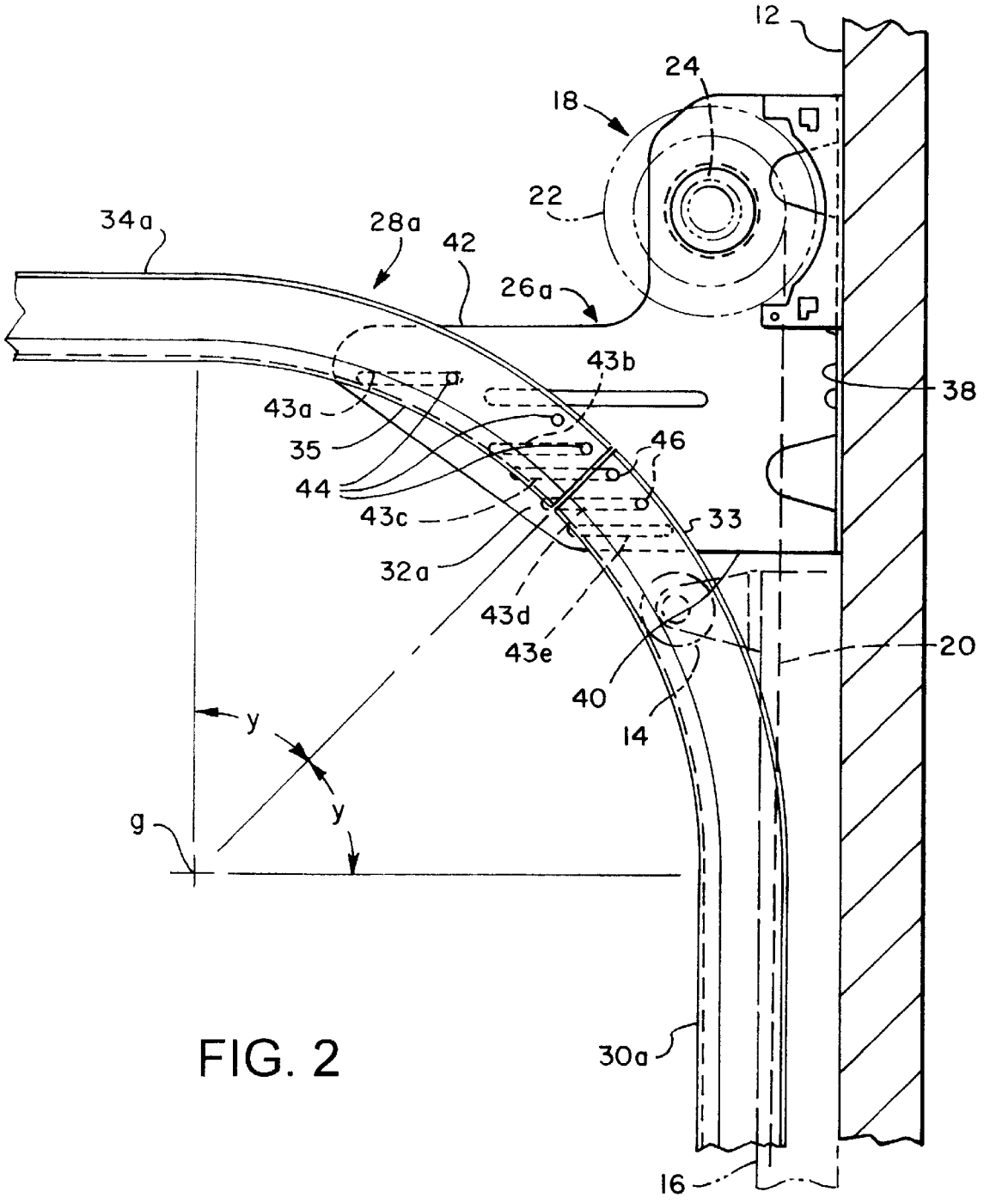
FIG. 2 is a view taken substantially from the line 2—2 of FIG. 1.

Referring now to FIG. 2, the track assembly 28*a* and bracket 26*a* are shown by way of example. Support bracket 26*a* includes a mounting flange 38 adapted to mount the bracket 26*a* on wall 12 by conventional fasteners, not shown. Bracket 26*a* includes an integrally formed support plate part 40 which extends normal to the flange 38 and includes an outer distal "flag" portion 42 provided with a plurality of generally elongated slots formed therein, see FIG. 3 also, and designated by numerals 43*a,* 43*b,* 43*c,* 43*d* and 43*e,* which slots are generally parallel to each other and are staggered so as to extend along a radius of curvature corresponding substantially to the radius of curvature of the track transition section 32*a*. As shown in FIG. 2, track sections 30*a* and 34*a* are provided with spaced apart fastener receiving openings 44 and 46, respectively, which are alignable with selected ones of the slots 43*a,* 43*b,* 43*c,* 43*d* and 43*e,* respectively, as shown. Conventional mechanical fasteners, not shown, may thus be used to join the track sections 30*a* and 34*a* to the bracket 26*a* at the respective fastener receiving openings described on each of the track sections and on the bracket flag portion 42. The slots in bracket 26*a* are provided such that vertical and horizontal adjustment of the positions of the track sections 30*a* and 34*a* may be obtained while at least two fastener receiving openings in each track section are each aligned with a slot in the bracket.

As shown in FIG. 2, the track sections 30*a* and 34*a* each include an equal portion of the transition section 32*a* formed thereon and designated by the numerals 33 and 35, respectively. Accordingly, the circumferential extent of the curved, generally circular radiused portions of track sections 30*a* and 34*a* are each approximately 45°, angle "y" in FIG. 2, with respect to the axis "g" of the radius of curvature. In this way an additional mounting bracket, such as one of brackets 25 for track section 30*a,* FIG. 1, or a similar horizontally extending bracket, may be eliminated and the track sections 30*a* and 34*a* may also be more easily stacked and packaged for shipment to an installation site. As shown in FIG. 2, the track sections 30*a* and 34*a* are adapted to be positioned directly adjacent to each other and suitably connected to the support bracket 26*a*. The track sections 30*b* and 34*b* are of identical construction but of the opposite hand and, as previously mentioned, the bracket 26*b* is substantially a mirror image of the bracket 26*a*.

Another advantage of the track assemblies 28*a* and 28*b* is that by providing the curved transition section 33 of track section 30*a,* for example, the uppermost guide member 14, see FIG. 2, resides in the vertical track section 30*a* in the closed position of the door 10. The uppermost guide member 14 on the opposite side of the uppermost door panel 16 would also reside in the upper curved portion of track section 30*b*. In this way the track sections 30*a* and 30*b* may be erected and the door 10 assembled and supported in its closed position before erection of the track sections 34*a* and 34*b* would be required. Moreover, the door panel 16 may be moved into position during erection by inserting the guide members 14 into the upper end of the transition section 33 of track section 30*a* and the corresponding transition section of track section 30*b* after these track sections have been erected and supported by the wall 12. Again, this arrangement facilitates assembly of the door.

Figure 3:
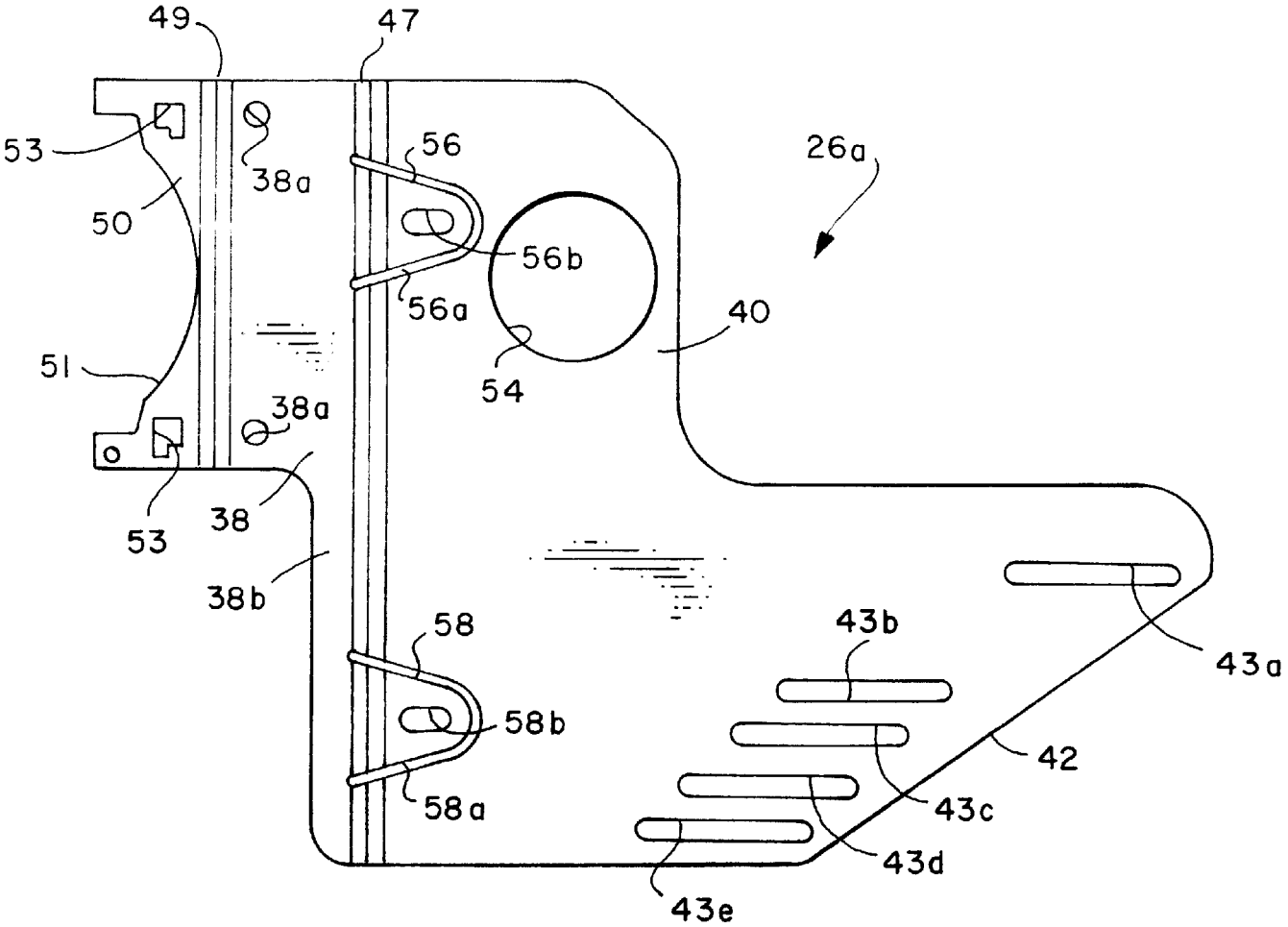
FIG. 3 is a developed plan view of a mounting bracket in accordance with the present invention for use with the door guide track assemblies of FIGS. 1 and 2.

Referring further to FIG. 3, the bracket 26*a* is shown in a planar developed view in which the flange 38 is coplanar with the support part 40 including its distal flag portion 42. The bracket 26*a* is shown in FIG. 3 before the bracket is folded along a first fold region 47 defined by three closely spaced dashed lines and before a second flange is formed extending normal to the flange 38 and in the same direction as the support part 40 by folding the bracket 26*a* along a second fold region 49 defined by a second set of closely spaced dashed lines, as shown. A second flange 50 formed by folding the metal plate which comprises the bracket 26*a* along the fold region 49 has a relieved surface 51 and openings 53 formed therein for receiving portions of the counterbalance mechanism as further described in the above identified patent application to Mondragon, et al.

Figure 4:
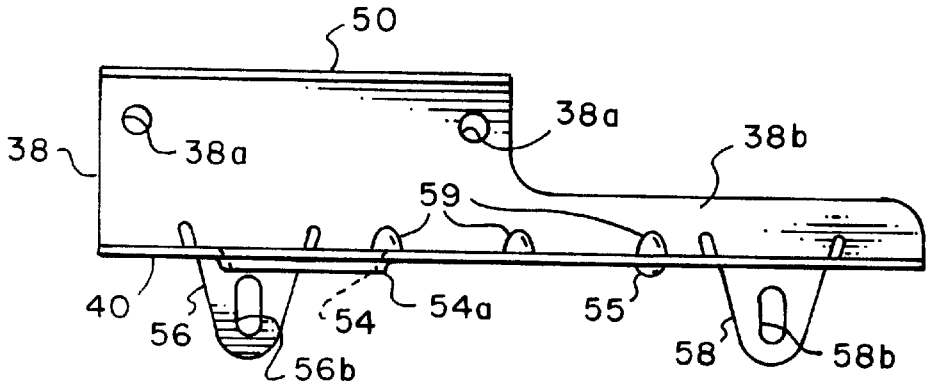
FIG. 4 is a front elevation of the mounting bracket of FIG. 3 in the final folded configuration.
Figure 5:
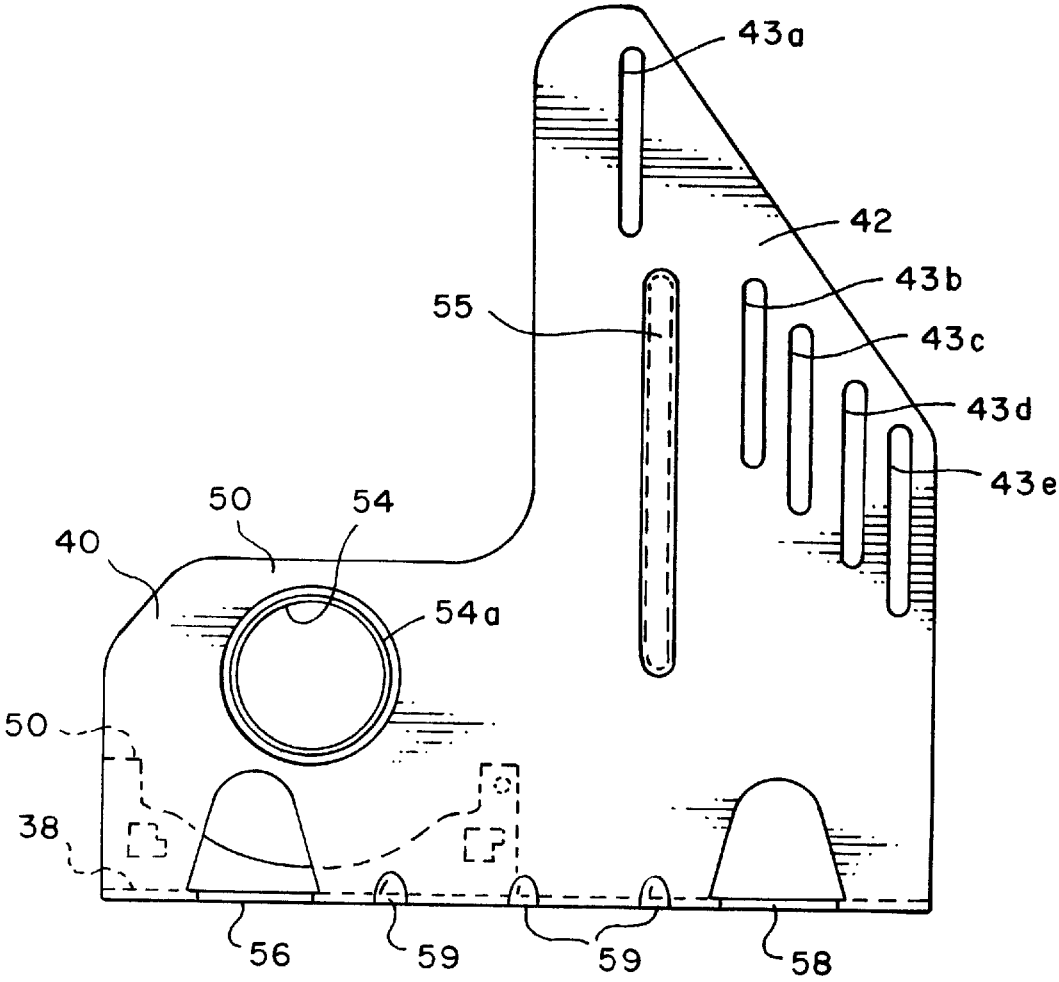
FIG. 5 is a side elevation of the mounting bracket shown in FIGS. 3 and 4.

As further shown in FIG. 3, the flange 38 is provided with fastener receiving holes 38*a* and the support part 40 is provided with a cylindrical bore 54 for receiving a bearing assembly for supporting the counterbalance mechanism support shaft 24, neither shown in FIG. 3. Lastly, the bracket 26*a,* when formed, is provided with two spaced apart bracket mounting tabs 56 and 58 which are formed by a coining or stamping operation by removing metal to form generally rectangular or, as shown, somewhat V shaped slits 56*a* and 58*a,* respectively. The base portions of the tabs 56 and 58 extend along the fold region 47 so that when the flange 38 is folded with respect to the support part 40 of bracket 26*a,* the tabs 56 and 58 remain substantially coplanar with the flange 38, as shown in FIGS. 4 and 5. Mounting tabs 56 and 58 include suitable fastener receiving slots 56*a* and 58*a,* respectively. As shown in FIGS. 3 and 4, the flange 38 includes a longitudinally extending portion 38*b* of approximately less than half the full width of the flange 38 to provide additional rigidity to the bracket support part 40, including the distal flag portion 42. The rigidity of the support part 40, 42 is further enhanced by an elongated rib 55, as shown in FIG. 5. Still further, the bearing bore 54 is also provided with a circumferential flange 54*a,* FIGS. 4 and 5, as part of the metal displacing operation which forms the bracket 26*a*.

Those skilled in the art will recognize that the brackets 26*a* and 26*b* may be formed from the same, so called blank part illustrated in FIG. 3 depending on which direction the folds are accomplished at the fold regions 47 and 49. The rigidity of the support brackets 26*a* and 26*b* may be further enhanced along the fold region 47 by forming respective gussets 59, FIGS. 4 and 5, by a suitable stamping or coining operation.

A major advantage of the brackets 26*a* and 26*b* is that these brackets provide the dual function of supporting a counterbalance mechanism for the door 10 as well as the respective track assemblies 28*a* and 28*b* for the door. Thanks to the provision of the elongated slots 43*a* through 43*e,* the position of track assembly 28*a* (as well as track assembly 28*b*) may be easily adjusted with respect to the wall 12 and floor 13, FIG. 1. Accordingly, the brackets 26*a* and 26*b* reduce the number of parts associated with the support structure for the door 10, are easily fabricated as substantially mirror images of each other and simplify door installation procedures.

Figure 6:
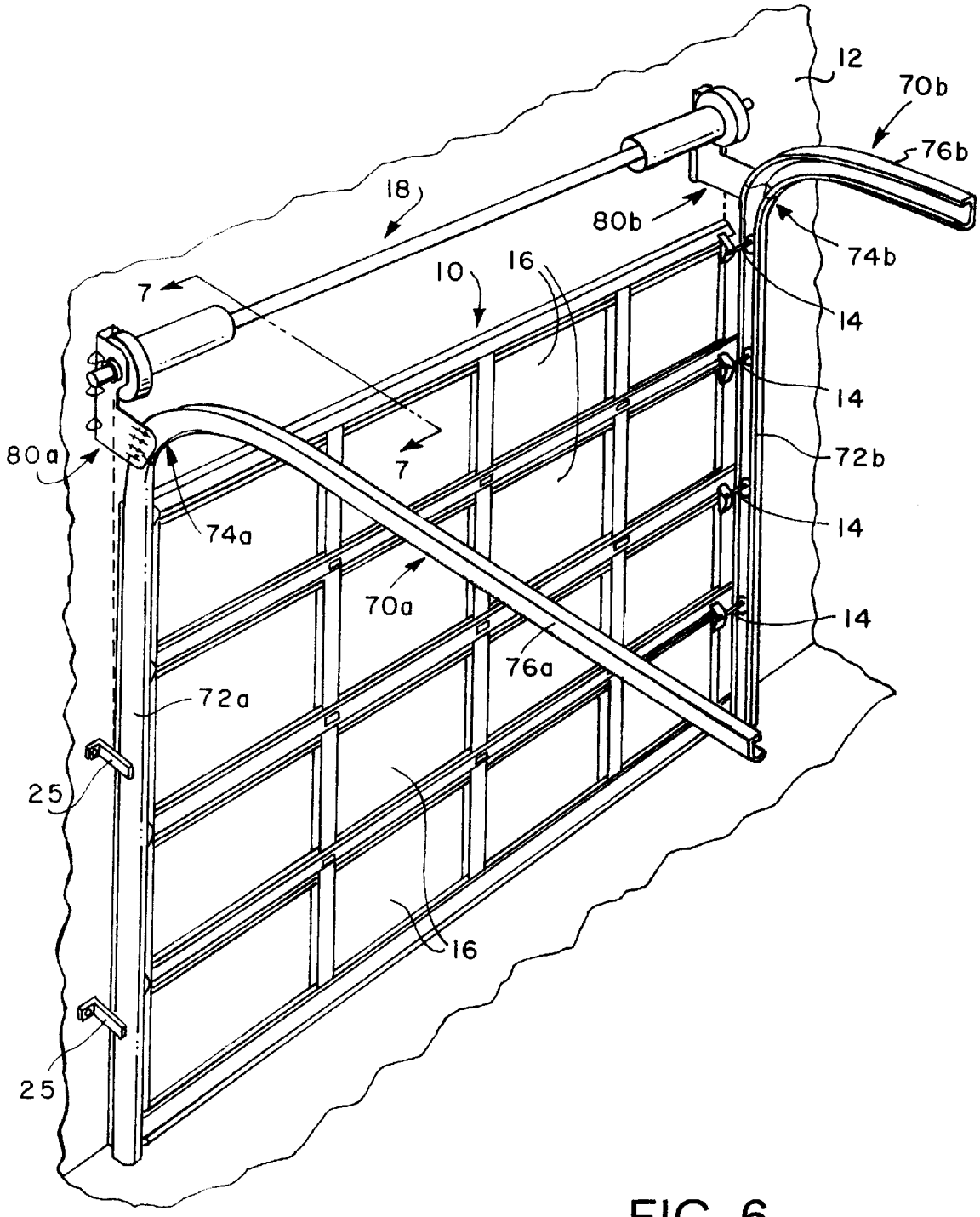
FIG. 6 is a perspective view of another preferred embodiment of guide track assemblies and mounting brackets therefor in accordance with the present invention.
Figure 7:
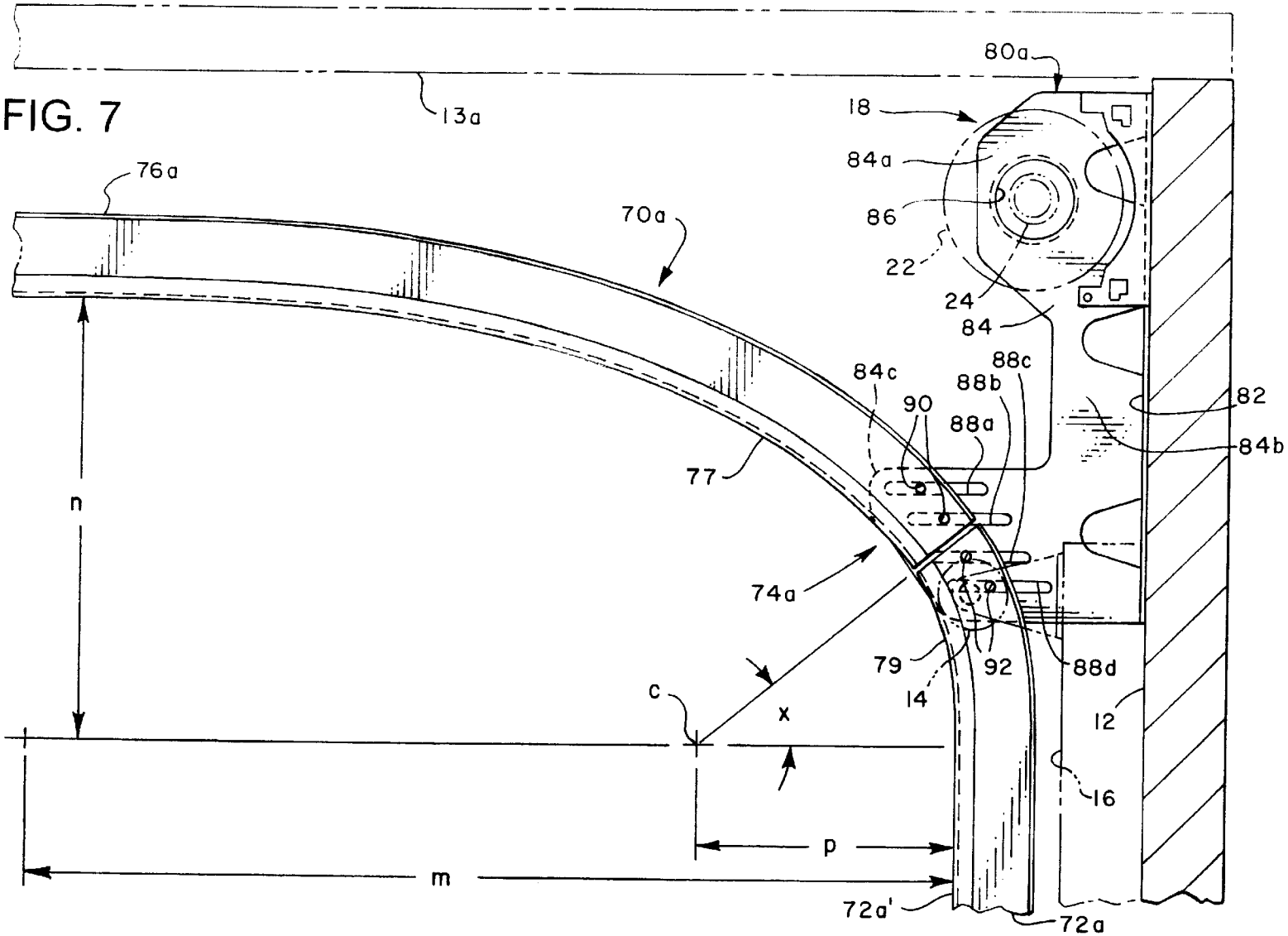
FIG. 7 is a view taken generally from the line 7—7 of FIG. 6.

Referring now to FIGS. 6 and 7, another embodiment of guide track assemblies for the door 10 is illustrated including an alternate embodiment of respective counterbalance mechanism and track assembly support brackets. In the embodiment shown in FIGS. 6 and 7, the door 10 is supported for movement between open and closed positions by respective spaced apart track assemblies 70*a* and 70*b*. Track assembly 70*a* includes a substantially vertically extending track section 72*a,* a curvilinear transition track section 74*a* and a generally horizontal extending track section 76*a*. In like manner, the track assembly 70*b* includes a generally vertical extending linear track section 72*b* comprising a mirror image of track section 72*a,* a curvilinear transition section 74*b* and a substantially horizontal extending track section 76*b,* being mirror images of track sections 74*a* and 76*a,* respectively. The curvilinear transition sections 74*a* and 74*b* are formed, in part, by the respective vertical and horizontal track sections of each track assembly. Moreover, the curvilinear transition sections 74*a* and 74*b* preferably have a substantially elliptical curvature throughout the transition section length wherein the major axis of the elliptical curvature extends generally horizontally and the minor axis of the elliptical curvature extends generally vertically. In this way, an improved arrangement of a track assembly is provided for low ceiling height or other low "headroom" applications of the door 10.

Referring primarily to FIG. 7, a portion of the track assembly 70*a* is shown by way of example. The transition section 74*a* is made up of a major portion of the transition section formed integral with the track section 76*a* and generally designated by numeral 77 while a major portion of the curvilinear section 74*a* is formed as part of the track section 72*a*. The curvilinear shape of the transition section 74*a,* including the portions 77 and 79 preferably has a major semiaxis m which is about twice the length of the minor semiaxis n. Preferred dimensions for the major and minor semiaxes are 20.0 inches and 10.0 inches, respectively. Distance p from the inside edge 72*a*' of track section 72*a* is approximately one-fourth of dimension m and angle x, which dictates the extent of the curvilinear track sections 77 and 79, is approximately 40° with respect to the center point c which is located on the major axis of the elliptical radius of curvature at dimension p from the vertical extent of track section 72*a*. As shown in FIG. 7, the configuration of the track assembly 70*a* as well as the track assembly 70*b* is advantageous with respect to applications of the door 10 in low ceiling height structures, as indicated by the ceiling 13 in FIG. 7. Other applications requiring low headroom or height of the guide track assemblies also benefit from the configuration of the track assemblies 70*a* and 70*b*. Moreover, track sections 72*a* and 72*b* are also operable to support the uppermost guide rollers 14 in the curvilinear transition sections of these track sections in the door closed position of the uppermost door panel 16.

Referring again to FIG. 6 also, alternate embodiments of combination counterbalance mechanism and track assembly mounting or support brackets are illustrated and generally designated by the numerals 80*a* and 80*b,* respectively. The brackets 80*a* and 80*b* are mirror images of each other and are formed from metal plate in substantially the same manner that the brackets 26*a* and 26*b* are formed. Referring primarily to FIG. 7, the bracket 80*a* is illustrated and is characterized by a generally planar flange part 82 adapted to be secured to the wall 12 by conventional mechanical fasteners, not shown. Flange part 82 is integral with and extends normal to an elongated support part 84 including a first upper portion 84*a* having a bearing bore 86 formed therein for receiving a support bearing, not shown, for the counterbalance mechanism shaft 24.

Support part 84 also includes a depending portion 84*b* and a distal, generally horizontally extending track or flag support portion 84*c*. Bracket flag portion 84*c* is provided with a plurality of spaced apart, staggered and parallel fastener receiving slots 88*a,* 88*b,* 88*c* and 88*d*. The slots 88*a,* 88*b,* 88*c* and 88*d* are adapted to be aligned with cooperating fastener receiving bores 90 and 92 formed in the respective track sections 76*a* and 72*a* as illustrated in FIG. 7, for receiving mechanical fasteners, not shown, to secure the track sections 72*a* and 76*a* to the bracket 80*a* and in generally abutting relationship to each other. The track assembly 70*b* is similarly configured for connection to the mounting bracket 80*b*.

Figure 10:
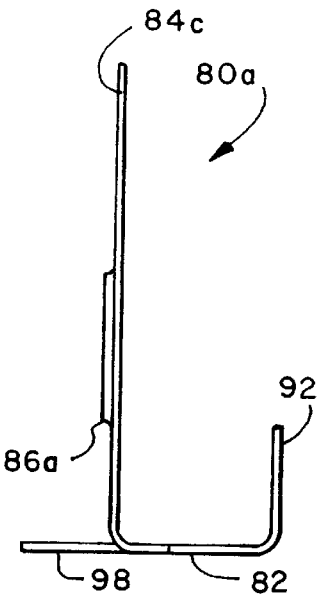
FIG. 10 is an end elevation of the bracket shown in FIG. 9.
Figure 8:
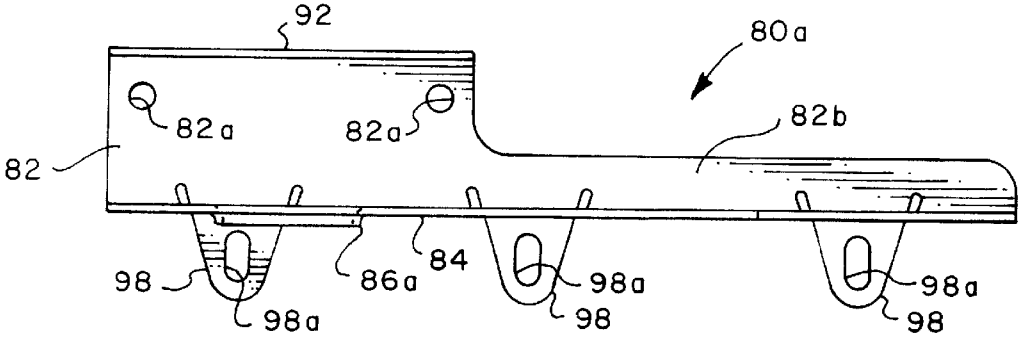
FIG. 8 is a front elevation of the mounting bracket for the guide track assembly of FIGS. 6 and 7.
Figure 9:
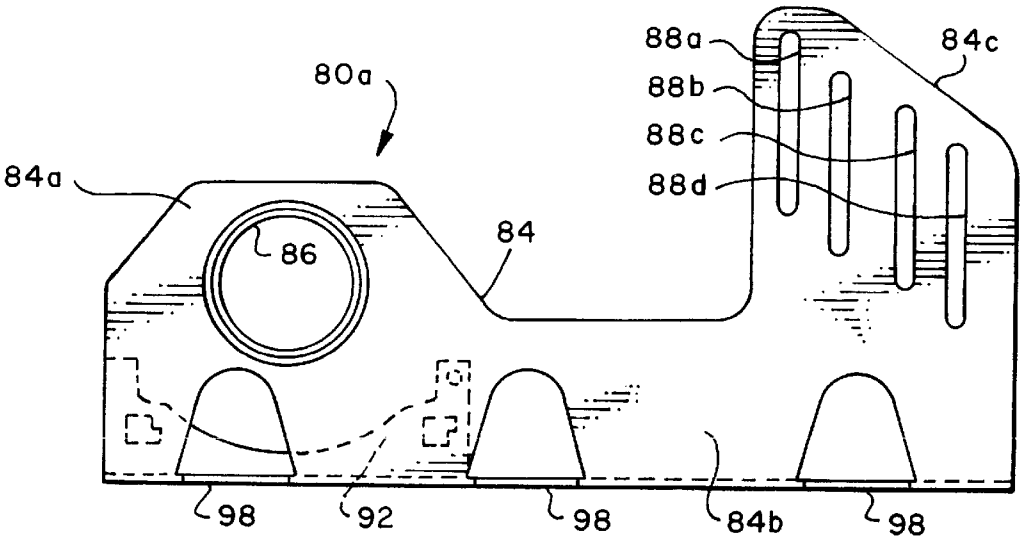
FIG. 9 is a side elevation of the mounting bracket embodiment of FIGS. 6 through 8.

Referring now primarily to FIGS. 8 through 10, the support bracket 80*a* is further illustrated as including a second flange part 92 similar to the flange part 50 of bracket 26*a* for connection to a spring winder support part of the counterbalance mechanism 18 previously described. The configuration of flange part 92 is substantially like that of flange part 50 and extends generally parallel to the support part 84 and spaced therefrom. Support or mounting bracket 80*a* also includes a circumferential flange 86*a* defining the bearing bore 86 and a plurality of spaced apart mounting tabs 98 which are formed by displacing material forming part of the support part 84 during the forming of the bracket 80*a* in the same manner that the mounting tabs 56 are formed for the bracket 26*a*. Elongated fastener receiving slots 98*a* and formed in the tabs 98 and fastener receiving bores 82*a* are formed in the flange 82. The flange 82 includes an elongated portion 82*b* of reduced width, FIG. 8, to strengthen and increase the rigidity of support part 84 of the bracket 80*a*.

The brackets 80*a* and 80*b* are formed in substantially the same manner as the brackets 26*a* and 26*b* and differ substantially only in their proportions and, for example, the number of mounting tabs 98 which are also coplanar with the flange 82. Accordingly, the brackets 80*a* and 80*b* enjoy the same advantages for supporting both the counterbalance mechanism and the door guide track assemblies in a manner substantially like that provided for by the brackets 26*a* and 26*b*. Moreover, the configuration of the elliptical curved transition sections 74*a* and 74*b* is such that the lengths of the distal flag portions of the brackets 80*a* and 80*b* are minimized and the rigidity of the brackets and track assemblies connected thereto is improved.

For residential garage door applications, primarily, the brackets 26*a*, 26*b*, 80*a* and 80*b* may be formed of rolled steel having a thickness of about 0.099 inches and the respective sections of the track assemblies 28*a*, 28*b*, 70*a* and 70*b* may also be formed of roll formed steel having a nominal thickness of about 0.049 inches to 0.099 inches. Fabrication of the track assemblies and support brackets described herein may be carried out using conventional roll forming, stamping or similar metal forming techniques known to those skilled in the art.

The construction and operation of the embodiments of the door 10 described hereinbefore, including the respective counterbalance mechanism support brackets 26*a*, 26*b*, 80*a* and 80*b* and the track assemblies 28*a*, 28*b*, 70*a* and 70*b*, is believed to be within the purview of one skilled in the art.

Although preferred embodiments of upward acting door track assemblies and support brackets have been described in detail herein, those skilled in the art will also recognize that various substitutions and modifications may be made without departing from the scope and spirit of the appended claims.

What is claimed is:

1. A guide track assembly for guiding movement of an upward acting door between open and closed positions, said guide track assembly including:

a first track section including an elongated linear track portion adapted to be mounted to extend substantially vertically;

a second track section including an elongated linear track portion adapted to be mounted extending substantially horizontally and separable from said first track section;

a curvilinear track section extending between said first and second track sections and forming a continuous curved part of said guide track assembly extending between said linear track portions, said curvilinear track section being formed as respective integral curvilinear portions of said first and second track sections, respectively, and said first and second track sections being adapted to be placed directly adjacent each other at cooperating ends of said respective curvilinear portions and supported at said ends for forming a continuous guide track assembly for guiding said door between open and closed positions; and a mounting bracket including a first part for connecting said mounting bracket to a wall and a second part connected to and supporting said curvilinear portions, respectively.

2. The guide track assembly set forth in claim 1 wherein:

said curvilinear track section has a substantially constant radius of curvature.

3. The guide track assembly set forth in claim 2 wherein:

said curvilinear track section comprises substantially equal length respective integral curvilinear portions of said first and second track sections, respectively.

4. The guide track assembly set forth in claim 1 wherein:

said curvilinear track section has a substantially elliptical curvature.

5. The guide track assembly set forth in claim 4 wherein:

said elliptical curvature of said curvilinear track section is characterized by a major axis and a minor axis, said major axis having a length approximately twice the length of said minor axis.

6. The guide track assembly set forth in claim 5 wherein:

a portion of said curvilinear track section formed on said first track section is defined by an arc having a center on the major axis of said elliptical curvature, said arc having a center spaced from one edge of said first track section approximately half the length of said minor axis of said elliptical curvature and extending over an angle of 35° to 45°.

7. The guide track assembly set forth in claim 4 wherein:

a major portion of said curvilinear track section is formed as said curvilinear portion of said second track section.

8. The guide track assembly set forth in claim 1 wherein:

said curvilinear portion of said first track section supports a guide member for said door in a closed position of said door.

9. The guide track assembly set forth in claim 1 wherein:

said first part of said mounting bracket includes a first flange for mounting said bracket on a vertical wall adjacent said guide track assembly and said second part comprises an integral support part extending substantially normal to said first flange and including a distal flag portion having plural elongated slots formed therein for receiving fasteners for connecting said first and second track sections to said mounting bracket at said curvilinear portions, respectively.

10. The guide track assembly set forth in claim 9 wherein:

said mounting bracket includes a second flange formed integral with said first flange and extending substantially normal thereto and spaced from said support part for connection to a counterbalance mechanism for said door.

11. The guide track assembly set forth in claim 10 wherein:

said mounting bracket includes a bearing bore formed therein for supporting bearing means for supporting a shaft of a counterbalance mechanism for said door.

12. The guide track assembly set forth in claim 10 wherein:

said mounting bracket includes plural mounting tabs formed thereon and extending substantially coplanar with said first flange and formed integral with said first flange.

13. The guide track assembly set forth in claim 12 wherein:

said mounting bracket is formed from a stamped metal plate which is folded along a first fold region to form said first flange and said support part and is folded along a second fold region to form said second flange integral with said first flange.

14. The guide track assembly set forth in claim 13 wherein:

said mounting tabs are formed by cutting said plate to define an outline of at least all but one side of said tabs, respectively, whereby upon folding said plate to form said first flange and said support part, said mounting tabs are formed by remaining unfolded with respect to said first flange.

15. In an upward acting door, opposed guide track assemblies for guiding movement of said door between open and closed positions, and opposed mounting brackets for supporting at least portions of said guide track assemblies, respectively, said brackets each including:

a first flange for mounting said bracket on a vertical wall adjacent a guide track assembly;

an integral support part extending substantially normal to said first flange and including a distal flag portion having plural elongated slots formed therein for receiving fasteners for connecting first and second track sections of said guide track assembly to said bracket, respectively; and plural spaced apart mounting tabs extending from one side of and coplanar with said first flange and operable to be engaged by fastener means for securing said bracket to said wall.

16. The invention set forth in claim 15 wherein:

said bracket includes a second flange formed integral with said first flange and extending substantially normal thereto and spaced from said support part for connection to a counterbalance mechanism for said door.

17. The invention set forth in claim 16 wherein:

said bracket includes a bearing bore formed therein for supporting bearing means for supporting a shaft of a counterbalance mechanism for said door.

18. The invention set forth in claim 15 wherein:

said bracket is formed from a stamped metal plate which is folded along a first fold region to form said first flange and said support part and is folded along a second fold region to form said second flange integral with said first flange.

19. The invention set forth in claim 18 wherein:

said mounting tabs are formed by cutting said plate to define an outline of at least all but one side of said tabs, respectively, whereby upon folding said plate to form said first flange and said support part, said mounting tabs are formed by remaining unfolded with respect to said first flange.

20. In an upward acting door, opposed multisection guide track assemblies for guiding movement of said door between open and closed positions, and opposed mounting brackets for supporting at least portions of at least two separate sections of said guide track assemblies, respectively, said brackets each including:

a first flange for mounting said bracket on a vertical wall adjacent a guide track assembly;

an integral support part extending substantially normal to said first flange and including a bearing bore formed therein for supporting bearing means for a shaft of a counterbalance mechanism for said door, and a distal flag portion having plural openings formed therein for receiving fasteners for connecting said two separate sections of said guide track assembly to said bracket, respectively;

plural mounting tabs formed integral with and coplanar with said first flange for connecting said bracket to support structure;

a second flange formed integral with said first flange and extending substantially normal thereto and spaced from said support part for connection to a counterbalance mechanism for said door; and said bracket is formed from a metal plate which is folded along a first fold region to form said first flange and said support part and is folded along a second fold region to form said second flange integral with said first flange.

21. The invention set forth in claim 20 wherein:

said mounting tabs are formed by cutting said plate to define an outline of at least all but one side of said tabs, respectively, whereby upon folding said plate to form said first flange and said support part, said mounting tabs are formed by remaining unfolded with respect to said first flange.

* * * * *